US006158848A

United States Patent [19]

Liu

[11] Patent Number: 6,158,848

[45] Date of Patent: Dec. 12, 2000

[54] REFILLING DEVICE FOR INK CARTRIDGE OF A JET PRINTER

[76] Inventor: Win-Yin Liu, P.O. Box 96-405, Taipei 106, Taiwan

[21] Appl. No.: 09/002,110

[22] Filed: Dec. 31, 1997

[51] Int. Cl.[7] ..... B41J 2/175

[52] U.S. Cl. ..... 347/85

[58] Field of Search ..... 347/84, 85, 86, 347/87, 92; 141/2

[56] References Cited

U.S. PATENT DOCUMENTS

| | | | |
|---|---|---|---|
| 5,329,294 | 7/1994 | Ontawar et al. | 347/87 |
| 5,526,030 | 6/1996 | Baldwin et al. | 347/87 |
| 5,933,175 | 8/1999 | Stathem et al. | 347/87 |

*Primary Examiner*—N. Le
*Assistant Examiner*—Anh T. N. Vo
*Attorney, Agent, or Firm*—Dougherty & Troxell

[57] ABSTRACT

A refilling device for an ink cartridge of a jet printer, including a rubber piece with a refilling hole aligned with an air vent of the maze passage glued to the ink cartridge. To refill ink, the refilling hole of the rubber piece must be in alignment with and connected with the mouth of the ink bottle. The ink in the bottle can be injected into the ink chamber of the ink cartridge by squeezing the ink bottle. As soon as the squeezing is released, the air in the ink chamber will be sucked into the ink bottle, and such squeezing and releasing can be repeated until the ink is completely injected. The ink bottle is removed and the air therein squeezed out. The ink bottle is re-connected with the refilling hole of the ink cartridge again to suck out the air left in the ink cartridge so as to furnish a negative pressure in the ink cartridge. When the hollow ink bottle is removed, the negative pressure in the ink cartridge will prevent leakage of the ink.

6 Claims, 14 Drawing Sheets

REFILLING DEVICE FOR INK CARTRIDGE OF A JET PRINTER

BACKGROUND OF THE INVENTION

1. Field of the Invention

This invention relates to an ink cartridge for a jet printer, and particularly to a simple refilling device for ink cartridge of a jet printer.

2. Description of the Prior Art

In the conventional jet printer, the ink is loaded in a cartridge, and the ink jetted on the printing paper is controlled with a jet nozzle; when ink in the cartridge is used up, the cartridge has to be replaced for further printing operation; however, the ink cartridge supplied by the original manufacturer is considerably expensive, i.e., a user to print a lot of papers will spend a lot of money.

In the conventional ink cartridge of a jet printer, the ink chamber of the ink cartridge is usually loaded with an equalization air-bladder or a piece of sponge for soaking and supplying ink. The ink cartridge supplied by the original manufacturer usually has an equal pressure in the ink chamber during the automatic manufacturing process, and there will be no leak during printing operation.

When refilling ink into a conventional hollow ink cartridge, and if such ink cartridge is furnished with an equalization air-bladder in the ink chamber thereof, a sticky tape should be used to close the air vent of the maze passage on the bottom of the ink cartridge so as to prevent ink from leaking; then, the intake hole of the air-bladder should also be closed with sticky tape so as to maintain equalization of pressure; then, use a sharp point to press the seal bead out of its position so as to provide a refilling hole. Take a suitable amount of ink with a syringe, and then inject the ink into the refilling hole on the ink cartridge slowly until the cartridge is full; use a plastic plug to seal the refilling hole, and then tear off the sticky tapes on the intake hole and on the bottom of the ink cartridge respectively; it is quite often that the opening end of the maze passage or the jet nozzle will have a leakage of ink after the sticky tape on the bottom of the cartridge is removed because the pressure in the ink chamber is not being equalized. To overcome such leakage, the only method is to rub off the ink leaked until the leak is stopped.

In another prior art, the ink cartridge is put in an ink-refilling box; the bottom of the ink-refilling box has a hermetic pad to close the maze passage on the bottom side of the ink cartridge. When the lid of the ink-refilling box is put thereon, the seal bead on the ink-refilling box will be pushed out of its normal position to provide an ink-refilling hole; a pipette connected with a syringe is plugged into the refilling hole on the lid of the ink-refilling box so as to refill ink; then, remove the lid and an air pump is inserted into the intake hole of air-bladder; use one hand to squeeze the air pump, while the other hand seals the ink-refilling hole with a plastic plug, and then the air pump is operated to have the air pressure in the ink cartridge equalized.

Still another prior art includes a hollow ink cartridge, in which the ink chamber is furnished with a sponge; when ink is filled into the cartridge, the sponge would provide a baffling effect to prevent the ink cartridge from being full directly; instead, the refilling operation is to be done slowly; however, such method is subject to causing an overflow out of the refilling hole to result in pollution.

In order to prevent leakage and pollution in the aforesaid ink cartridge, the front end of the syringe is mounted with an injection needle; the injection needle is inserted into the deep sponge so as to inject the ink into the ink chamber of the ink cartridge deeply. Unfortunately, when the ink is injected into the ink chamber, the ink in the sponge will generate bubbles, which prevents cause the ink cartridge from being filled fully and overflow would result in the event of injecting operation being too fast.

SUMMARY OF THE INVENTION

The prime object of the present invention is to provide a refilling device for an ink cartridge of a jet printer, having a rubber piece with a refilling hole; a adhesive on the inner side thereof is glued towards the air vent of the ink cartridge; the refilling hole of the rubber piece is aligned with the air vent of the ink cartridge; the air vent is sealed around with the adhesive; after the refilling hole of the rubber piece is connected with the mouth of the ink bottle, the ink will injected into the ink chamber of the ink cartridge.

Another object of the present invention is to provide a refilling device for ink cartridge of a jet printer, in which the rubber piece to be glued to the air vent of the ink cartridge is furnished with an adhesive, which is used to seal the inner side of the air vent; the outer side of the refilling hole on the rubber piece has a cylindrical hole, while the inner side thereof has a taper-shaped hole; the refilling hole is to be connected with the taper-shaped bottle mouth closely. The ink bottle is to be squeezed to force ink to inject into ink chamber of the ink cartridge without any leak.

Still another object of the present invention is to provide a refilling device for an ink cartridge of a jet printer, in which the rubber piece attached to the air vent is connected with the taper-shaped bottle mouth of the ink bottle to form into a through passage; the ink in the ink bottle is squeezed to inject ink into the ink chamber of the ink cartridge; after the ink bottle is released, the air in the ink chamber will be sucked into the ink bottle; by means of such air convection effect, the ink in the ink bottle can be injected into the ink chamber of the ink cartridge quickly.

A further object of the present invention is to provide a refilling device for an ink cartridge of a jet printer, in which the rubber piece has at least one refilling hole, of which the outer section is formed into a cylindrical hole, while the inner section thereof is formed into a taper-shaped hole; the larger opening end of the taper-shaped hole is glued and connected with the air vent of the ink cartridge so as to facilitate the refilling hole of the rubber piece to be aligned with and glued to the outer surface of the air vent quickly.

Still a further object of the present invention is to provide a refilling device for an ink cartridge of a jet printer, in which the ink chamber is loaded with a piece of sponge; after the refilling hole of the rubber piece is connected with the taper-shaped bottle mouth, the ink bottle will be squeezed to have the ink injected into the ink chamber of the ink cartridge; as soon as the squeezing is released a negative pressure will be generated to suck air left in the ink chamber; further, the air left in the sponge will also be sucked out to prevent from leak during the refilling operation.

DETAILED DESCRIPTION OF THE PREFERRED EMBODIMENT

Figure 1:
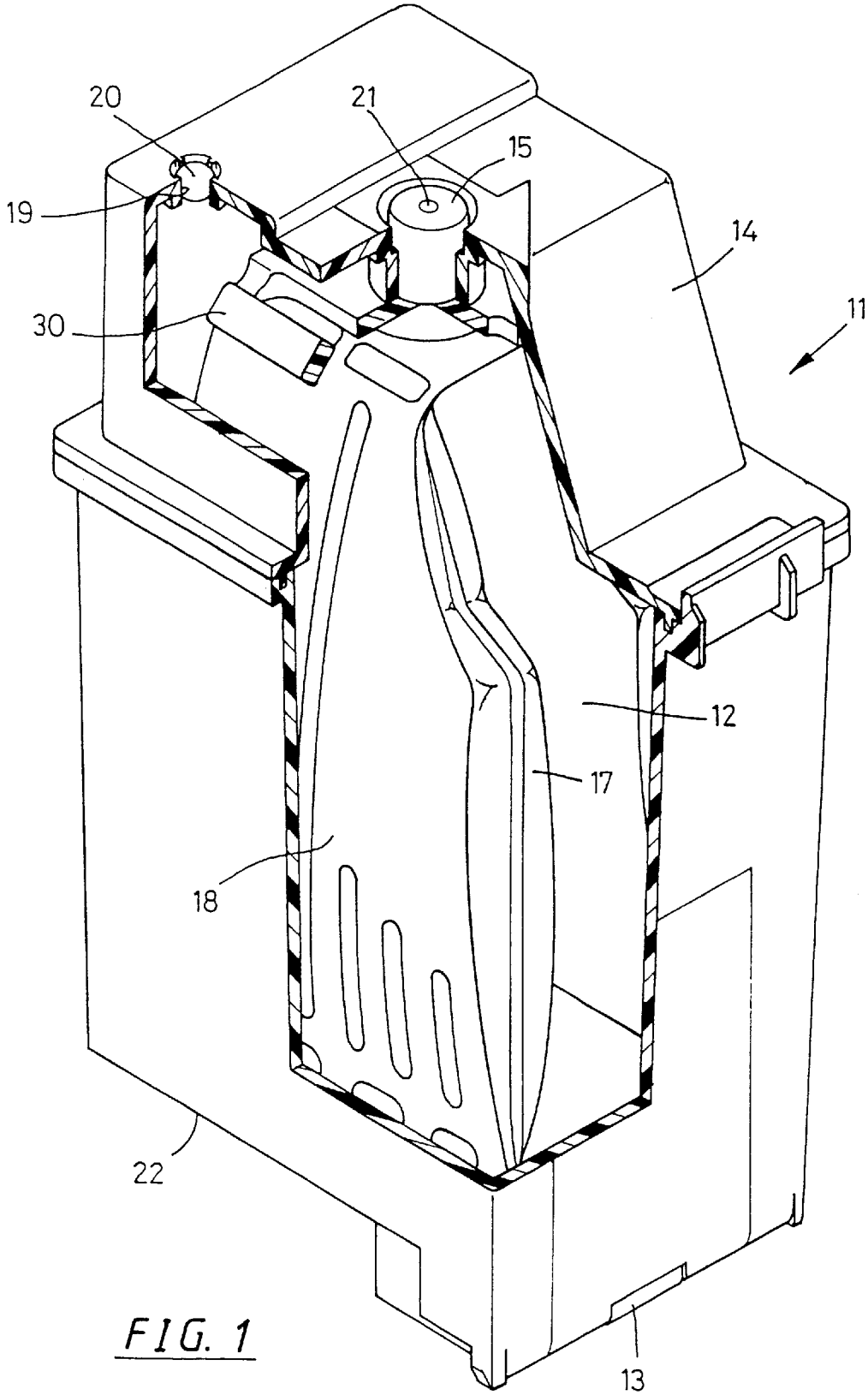
FIG. 1 is a perspective and sectional view of the present invention, showing the inner structure of the ink cartridge.
Figure 2:
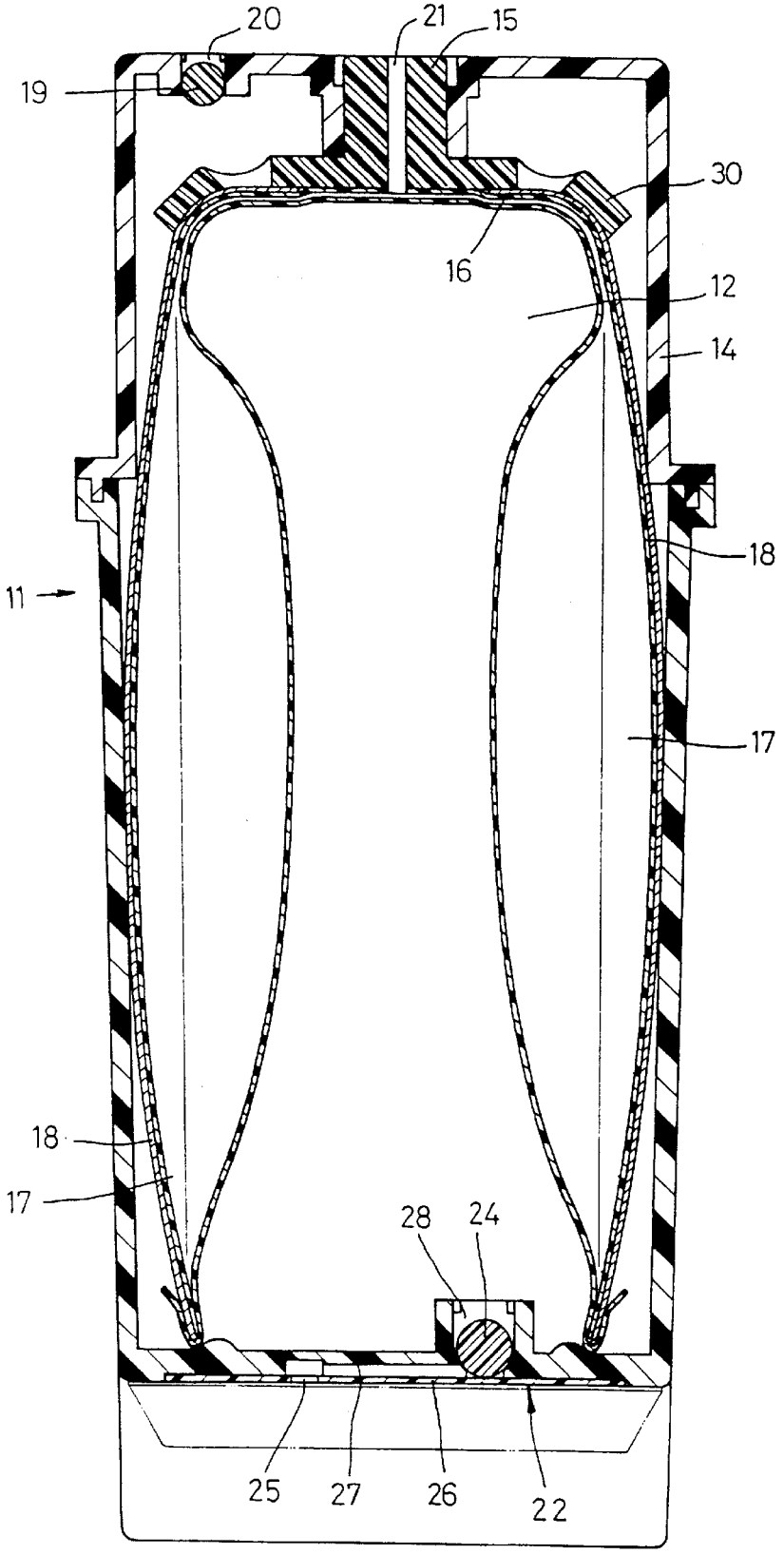
FIG. 2 is a sectional view of the ink cartridge of the present invention, showing the inner structure thereof.
Figure 3:
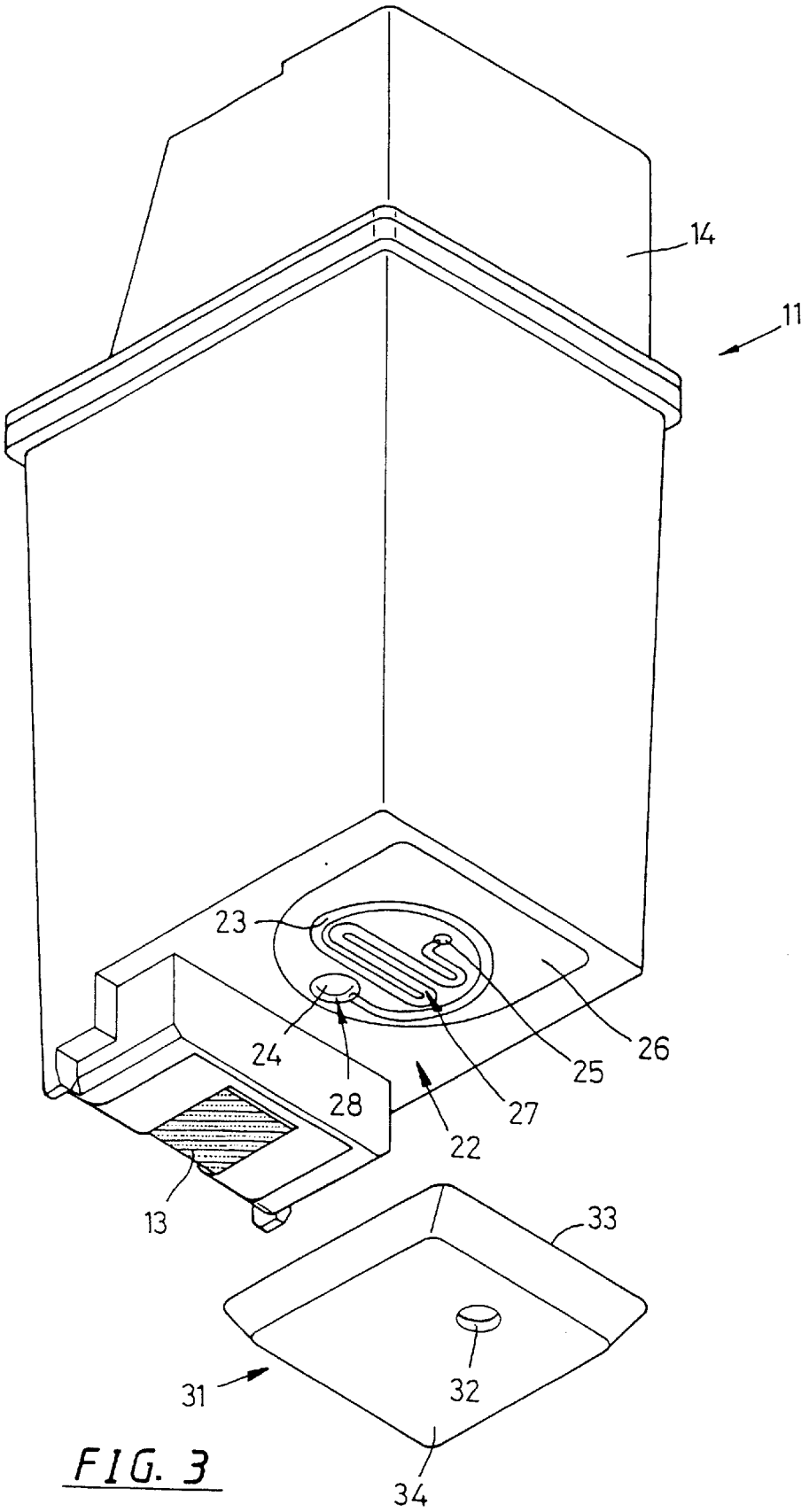
FIG. 3 is an outer view of the present invention, showing the relation between the rubber piece and the flat bottom thereof.

Referring to FIGS. 1 to 3, an ink cartridge 11 for a jet printer (HP 51626A) is shown; before refilling the ink cartridge 11, the structure thereof must be understood. In the ink cartridge 11, there are two symmetrical air-bladders 17 and two pressing plates 18; there is a supporting plate 30 mounted on the upper ends of the air-bladders and the pressing plates 18 and the plate 30 is fastened to a cylinder 15; the cylinder 15 is fixed in a round hole of a body part 14 of the ink cartridge 11. The center of the cylinder 15 has an intake hole 21 to allow air to enter the air-bladders 17 via a passage 16. The pressing plates 18 are made of a thin metal, having a suitable force for regulating the variation of the air-bladders 17; a refilling hole 19 is furnished at one side of the top of body part 14 to facilitate filling ink into the ink chamber 12 of the ink cartridge 11. As soon as the ink chamber 12 is fully filled with ink, the refilling hole 19 should be sealed with a plastic bead 20 so as to separate the ink from the atmospheric pressure. The flat bottom 22 of the ink cartridge 11 is provided with a maze groove 23, of which one end has a cylindrical hole 28 filled with a regulating bead 24; there is a very fine passage 29 furnished between the regulating bead 24 and the inner surface of the cylindrical hole 28. The maze groove 23 is covered with a membrane 26 to form into a maze passage 27. The other end of the maze passage 27 connects with an air vent 25 in communication with the atmosphere. The ink pressure in the ink chamber 12 can be equalized by means of the maze passage 27 and the air-bladders 17 to prevent the ink from leaking out of the jet nozzle 13 of the ink cartridge 11.

It is noted that when ink is refilled into the ink chamber 12 of the ink cartridge 11, the plastic bead 20 sealing the refilling hole 19 on the upper body part 14 will be pushed away from its normal position; when the ink chamber 12 is filled with ink, the air-bladder 17 in the ink chamber 12 will be pressed into a flat shape; simultaneously, the ink in the ink chamber 12 will leak out via the maze passage 27 on the flat bottom 22 of the ink cartridge 11. The ink chamber 12 having an equalization effect according to the conventional operation steps would push the plastic bead 20 normally sealing the refilling hole 19 away from its normal position; when the ink chamber 12 is full with ink, leakage of ink out of the maze passage 27 and the jet nozzle 13 on the flat bottom 22 will take place, and the user is usually unable to overcome that problem; the only way to eliminate such leak is to rub the leaked ink slowly.

Figure 4:
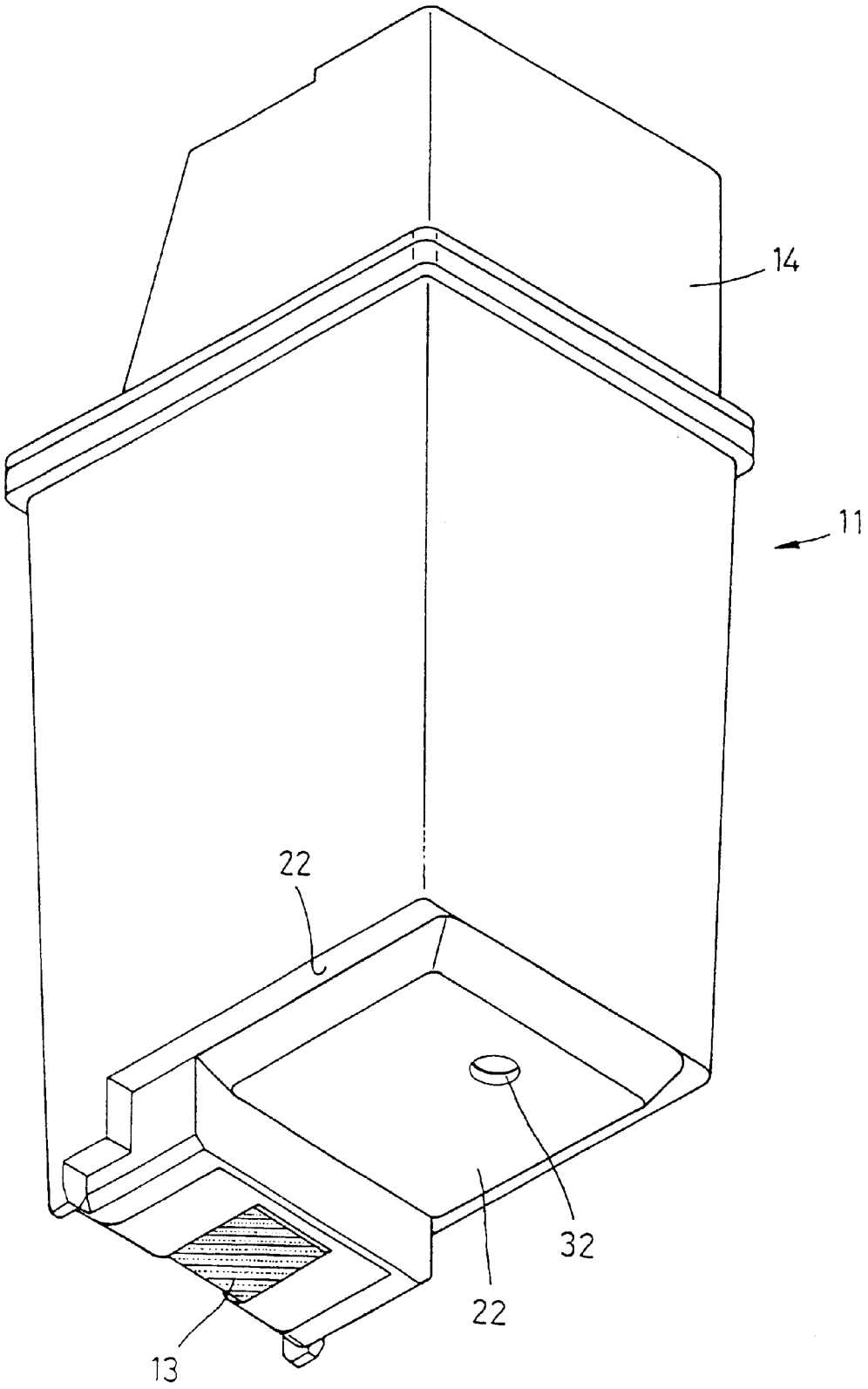
FIG. 4 is an outer view of the present invention, showing the rubber piece glued to the bottom of the ink cartridge.
Figure 5:
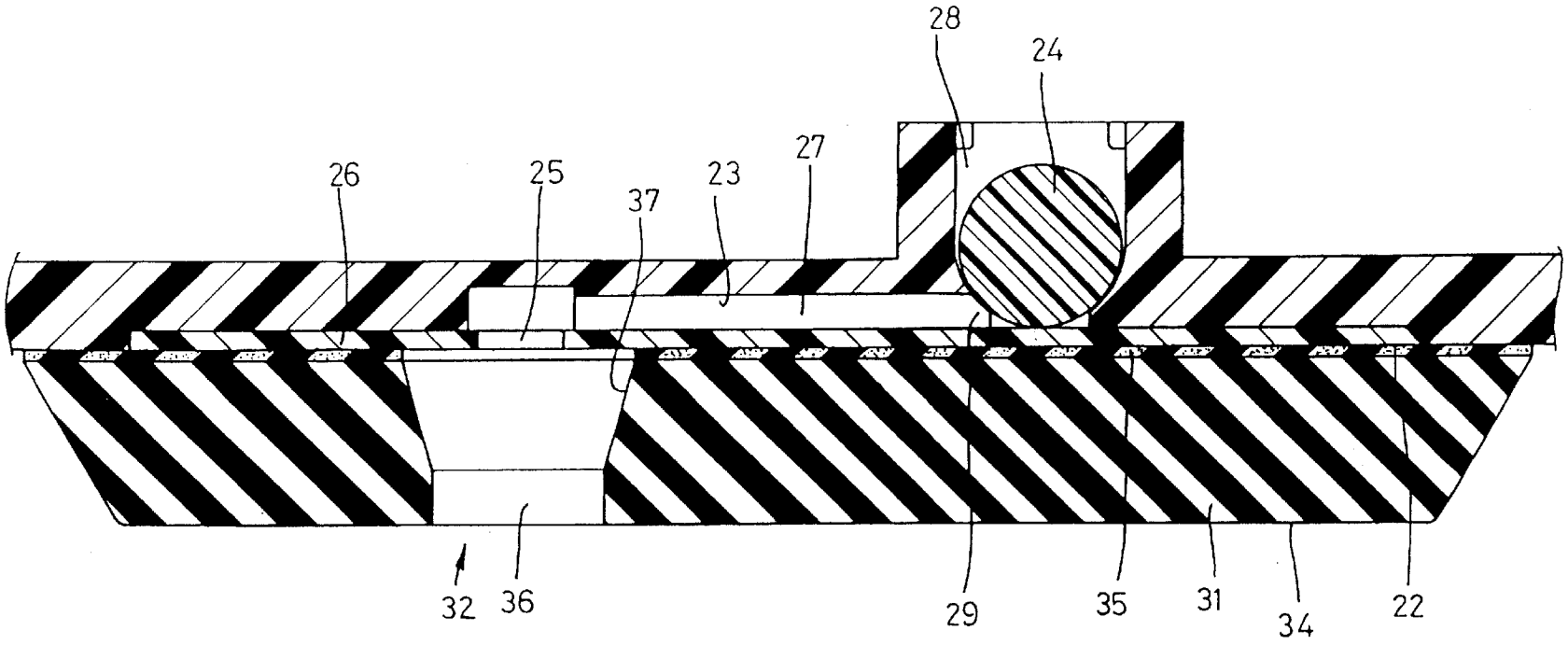
FIG. 5 is a sectional view of the present invention, showing the rubber piece glued to the ink cartridge.

Referring to FIGS. 3 to 5, a refilling device for an ink cartridge of jet printer according to the present invention is shown; the ink cartridge 11 can be refilled without damaging the outer part of the same. The refilling device includes a rubber piece 31 glued to the flat bottom 22 with a refilling hole 32; the refilling hole 32 on the rubber piece 31 is in communication with the air vent 25. The inner side of the refilling hole 32 of rubber piece 31 is surrounded with an adhesive 35 so as to have the air vent 25 of the ink cartridge 11 sealed in a hermetic condition; when the refilling hole 32 of the rubber piece 31 is connected with the taper-shaped bottle mouth 39 of an ink bottle 38, the ink will be filled into the ink chamber 12 of the ink cartridge 11.

The rubber piece 31 having adhesive is designed into a shape in accordance with the shape of the flat bottom 22 on the air vent 25; when the rubber piece 31 is glued to the flat bottom on the air vent 25, the refilling hole 32 of the rubber piece 31 will align with the air vent 25 of the ink cartridge 11. The inner side 33 of the rubber piece 31 is furnished with an adhesive 35. Before the rubber piece 31 is attached in place, the surface of the adhesive 35 is covered with a release paper. The rubber piece 31 is furnished with at least one refilling hole 32, which include an outer cylindrical hole 36 and an inner taper-shaped hole 37; the diameter of the cylindrical hole 36 is equal to or less than that of the nozzle end 40 of the ink bottle 38 so as to provide a close connection upon mounting on the nozzle end 40 of the ink bottle 38. The opening end of the inner taper-shaped hole 37 is larger than the diameter of the air vent 25 of the ink cartridge 11. When the refilling hole 32 of the rubber piece 31 faces the air vent 25 of the ink cartridge 11 for gluing together, the large hole should align with the small hole so as to facilitate the taper-shaped hole 37 to align with the air vent 25 of the ink cartridge 11.

When refilling, the ink cartridge 11 must be removed from the printer, tear off the adhesive release paper on the inner side 33 of the rubber piece 31, and adjust the location of the refilling hole 32 of the rubber piece. The rubber piece 31 is glued to the flat bottom 22 of the air vent 25, and the adhesive 35 on the inner side 33 of the rubber piece 31 will surround the air vent 25 of the ink cartridge 11; the ink cannot leak out through the glued surfaces during the refilling operation.

After the rubber piece 31 is glued to the flat surface around the air vent 25 of the ink cartridge 11, the inner side of the taper-shaped hole 37 of the refilling hole 32 on the rubber piece 31 is larger than the size of the air vent 25 of the ink cartridge 11. The shape and size of the rubber piece 31 is similar to that of the flat bottom 22. When the rubber piece 31 is glued in place, the refilling hole 31 of the rubber piece 32 will align with the air vent 25 of the ink cartridge 11.

Figure 6:
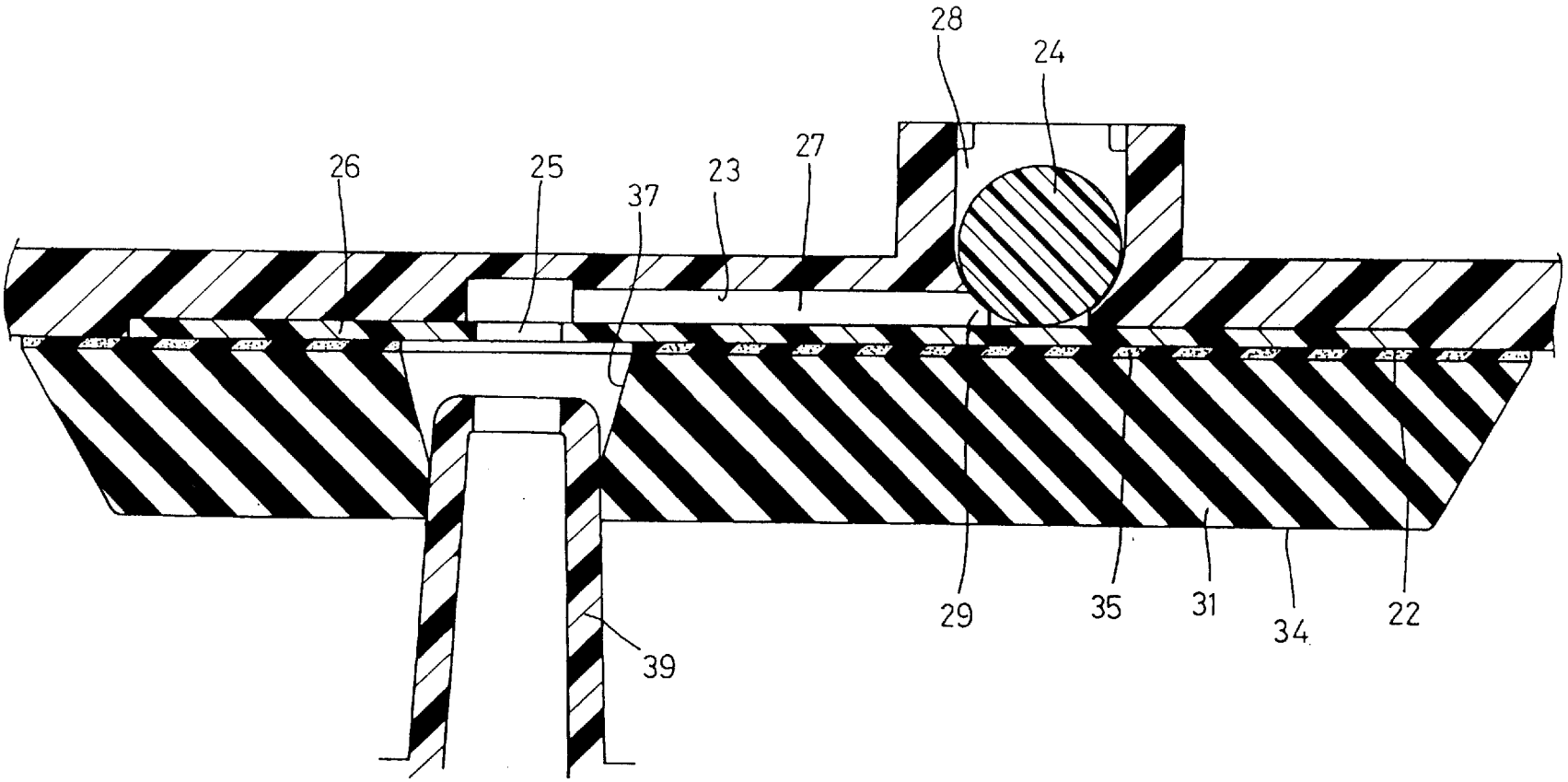
FIG. 6 is a sectional view of the present invention, showing an ink bottle connected with the rubber piece.
Figure 7:
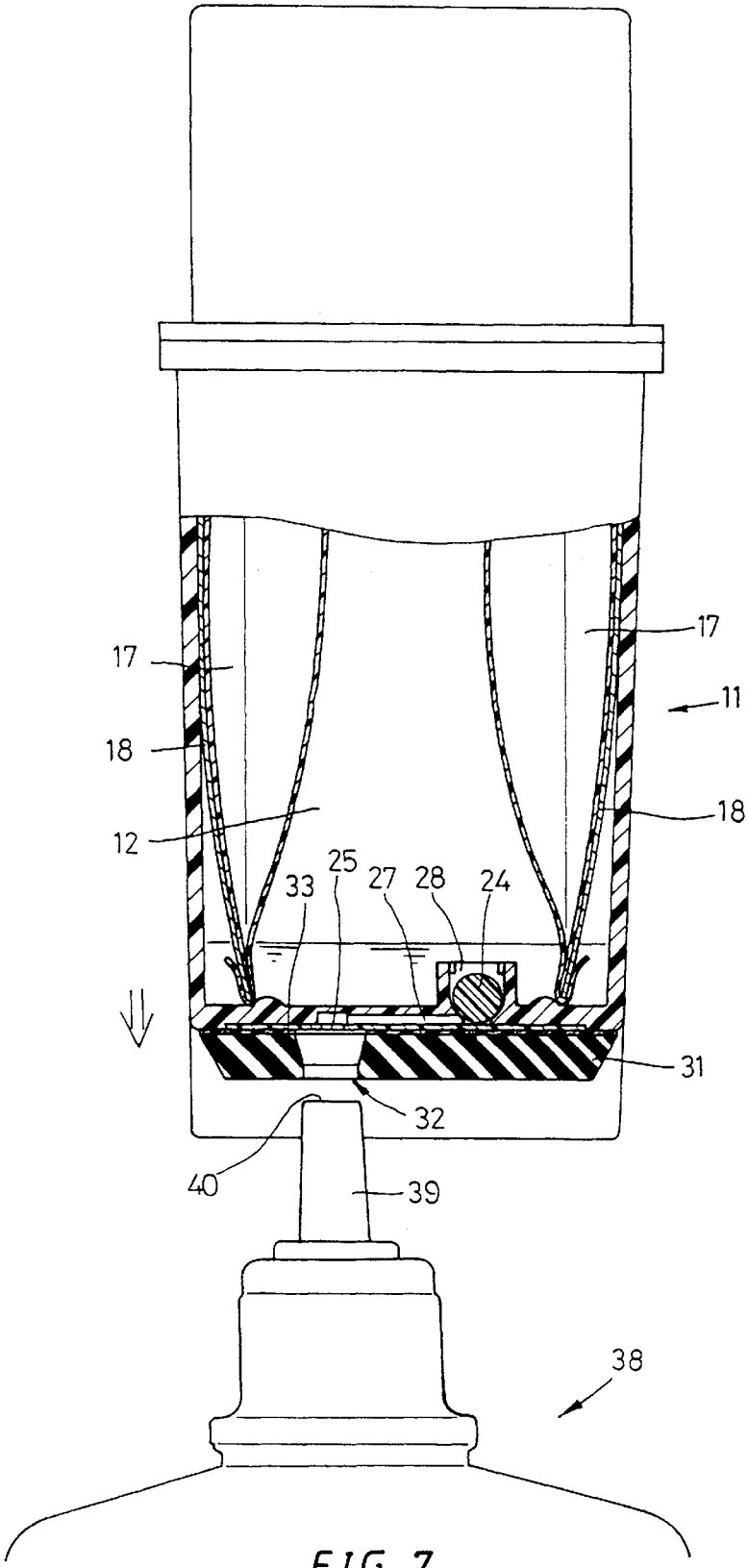
FIG. 7 is a sectional view of the present invention, showing the ink cartridge moving towards the ink bottle for connection.
Figure 8:
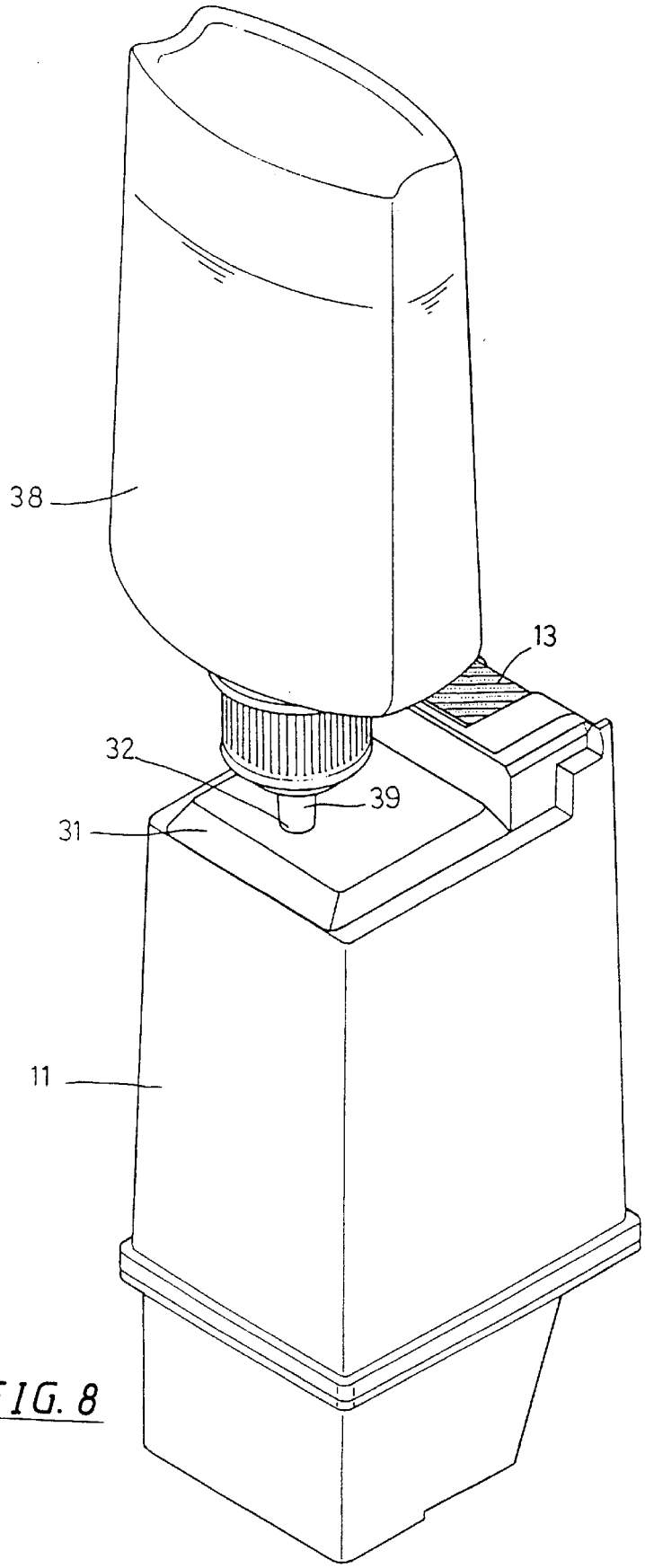
FIG. 8 is a perspective view of the present invention, showing the ink cartridge moving towards the ink bottle for connection.
Figure 9:
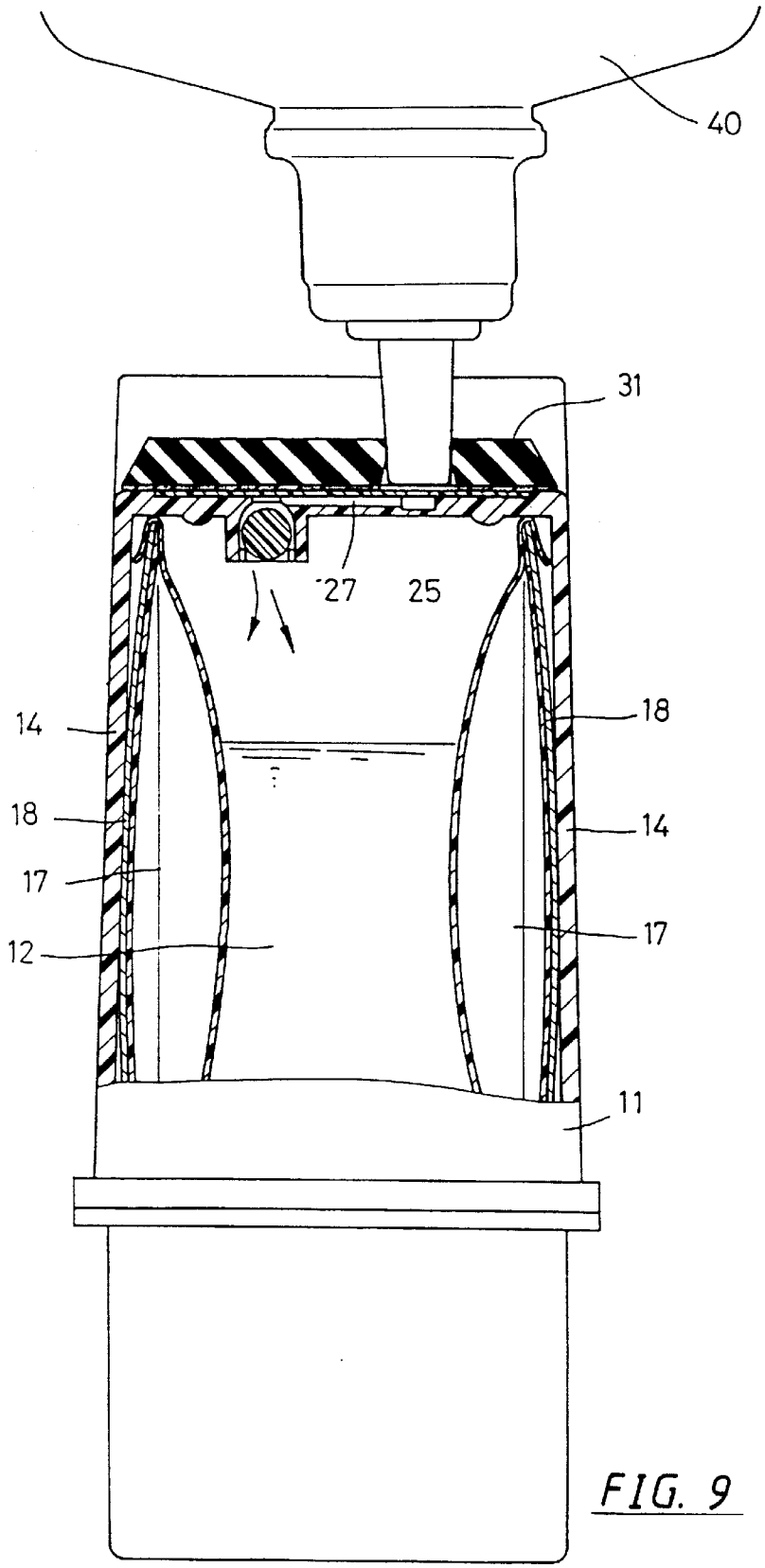
FIG. 9 is a sectional view of the present invention, showing cartridge being full with ink.

Referring to FIGS. 5 to 7, the ink cartridge 11 glued with the rubber piece 31 is turned down to have the refilling hole 32 of the rubber piece 31 facing downwards, and then the cylindrical hole 36 of the refilling hole 32 will align with the nozzle end 40 of the ink bottle 38; then, nozzle end 40 is pushed with a given force so as to have the taper-shaped bottle mouth 39 inserted into the refilling hole 32 of the rubber piece 31 in close contact with the cylindrical hole 36 of the refilling hole 32. Referring to FIGS. 8 and 9, the ink cartridge 11 and the connected ink bottle 38 are turned upside-down, and then the ink bottle 38 is squeezed by hand to cause the ink to flow into the ink chamber 12 of the ink cartridge 11; as soon as the hand is removed from the ink bottle 38, the air inside the ink chamber 12 of the ink cartridge 11 will be sucked back into the ink bottle 38, and repeat the same steps until all ink is filled therein.

The ink chamber 12 of the ink cartridge 11 has a given maximum capacity; the capacity of the ink bottle 38 should be equal to or slightly less than that of the ink cartridge 11. As soon as the ink chamber 12 of the ink cartridge 11 is filled fully with ink from the ink bottle 38, the air in the ink chamber 12 will be replaced with ink; then, the pressure of the ink chamber 12 will slightly be higher than that with air therein; the air-bladder 17 in the ink chamber 12 will be squeezed, i.e., the pressure in the ink chamber 12 being changed. If the pressure in the ink chamber 12 is not removed, the ink therein will leak out via the maze passage 27 and the jet nozzle 13.

Figure 10:
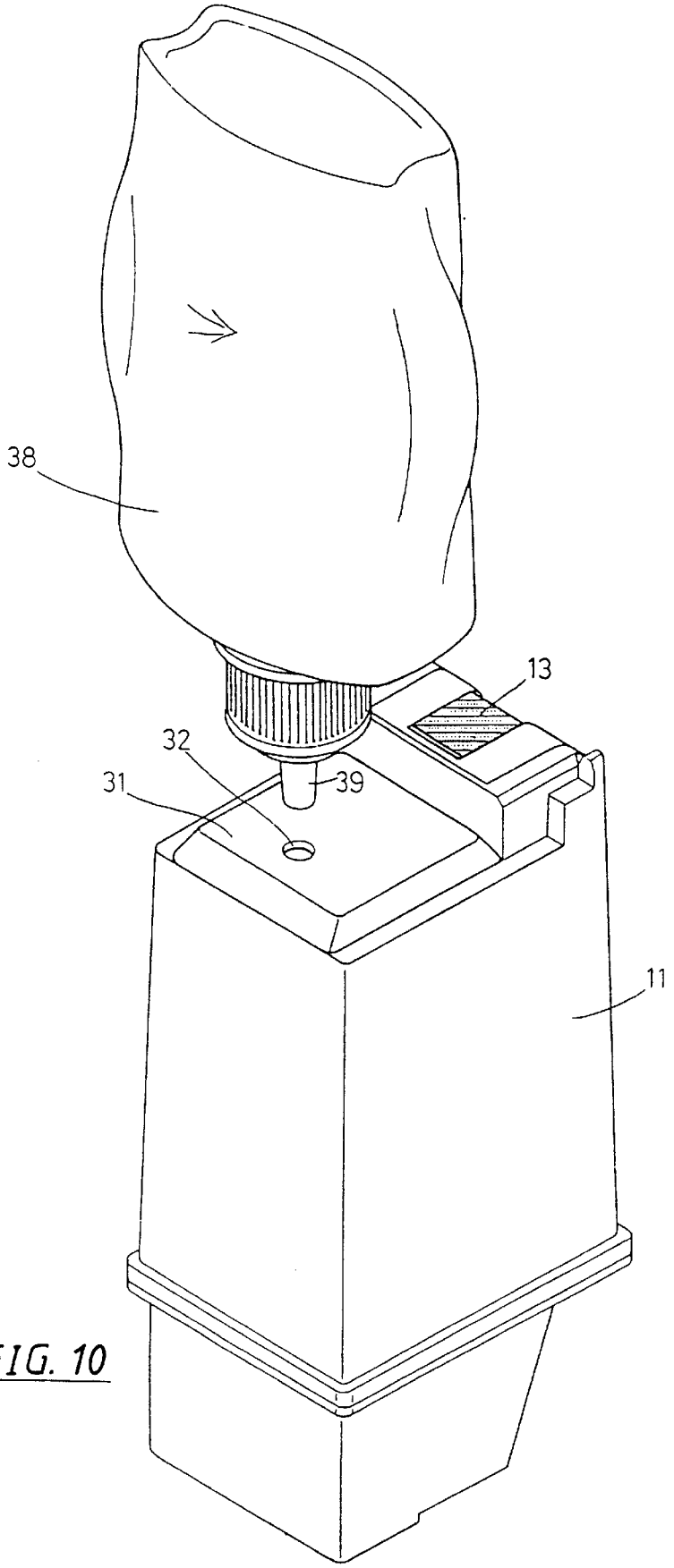
FIG. 10 is a perspective view of the present invention, showing a hollow ink bottle mounted on the cartridge.

In order to equalize the pressure in the ink chamber 12, the hollow ink bottle 38 must be removed as shown in FIG. 10, and then squeeze out the air in the ink bottle 38; then, let the ink bottle connect to the refilling hole 32 of the rubber piece 31, and release the hand squeezing the ink bottle so as to suck out the air in the ink cartridge 11, i.e., to have the pressure in the ink cartridge become a negative pressure. As a result of the negative pressure, the air-bladder 17 will expand; then, remove the ink bottle, and the negative pressure in the ink cartridge 11 will suck in a suitable amount of air via the air vent 25 of the maze passage 27 so as to equalize the pressure in the ink cartridge. When the atmospheric air is sucked into the ink chamber 12 via the air vent 25 of the maze passage 27 of the ink cartridge 11, the ink left in the maze passage 27 will also be sucked into the ink chamber 12 so as to maintain the maze passage 27 under a clean condition without having any ink to leak out.

For the ink cartridge 11 furnished with the air-bladder 17 and the maze passage 27, the rubber piece 31 can be glued directly to the air vent 25 of the maze passage 27. By means of the aforesaid procedures for the ink bottle 38, the ink-refilling operation can be done. If the ink chamber 12 of the ink cartridge 11 is loaded with a sponge, the rubber piece 31 can also be glued to the refilling hole of the ink cartridge 11; when the ink bottle 38 is connected with the refilling hole 32 of the rubber piece 31, the refilling operation will be done.

Figure 11:
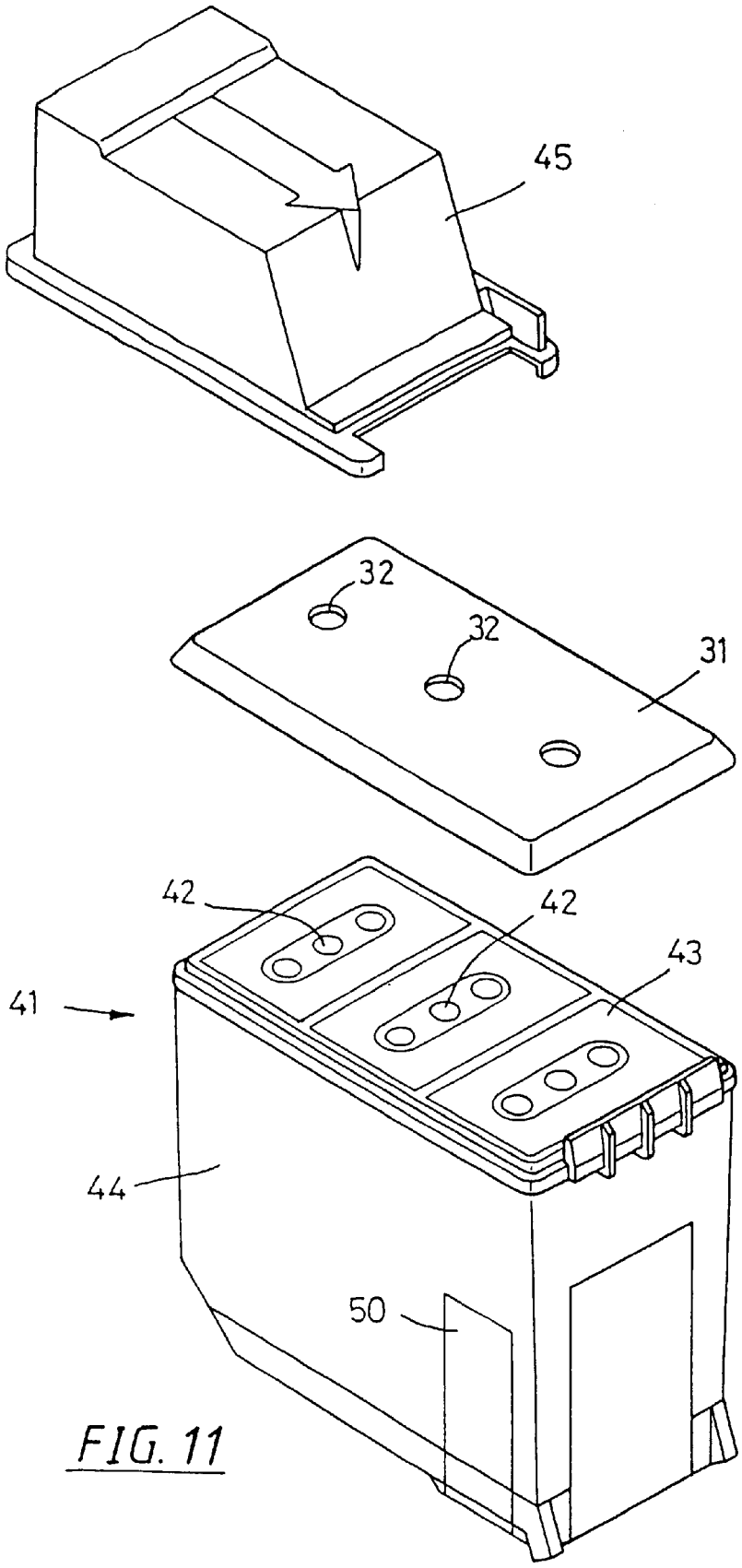
FIG. 11 is a disassembled view of the present invention, showing the rubber piece being separated from the ink cartridge.

Referring to FIG. 11, the ink cartridge is a color cartridge 41 (HP C 1816A) for HP jet printer; the body part 44 of the color cartridge 41 is partitioned into three chambers, of which each is loaded with a piece of sponge for absorbing ink. When printing, the ink can be drawn to the jethead by means of a siphon. The tops of the three ink chambers in body 44 of the color cartridge 41 are sealed with a top lid 43, on which a cap 45 is mounted. The color cartridge 41 can be refilled by using a conventional tool to remove the cap 45 from the body 44; then, tear off the release paper on the inner side of the rubber piece 31 furnished with a plurality of refilling holes 32 before gluing to the flat side of the top lid 43 of the body 44; each refilling hole 32 of the rubber piece 31 aligns with a corresponding refilling hole 42 of the top lid. The lower part of the body 44 has a jet nozzle, on which a glue tape 50 is glued to seal the nozzle. The body 44 of the color cartridge 41 is connected with an ink bottle, being squeezed by hand so as to have the ink injected into the ink chamber of the body 44. As soon as the ink bottle is released from squeezing, a negative pressure will be generated to suck air out of the sponge until the chamber is full with ink; then, no leak would take place during the refilling operation.

Figure 12:
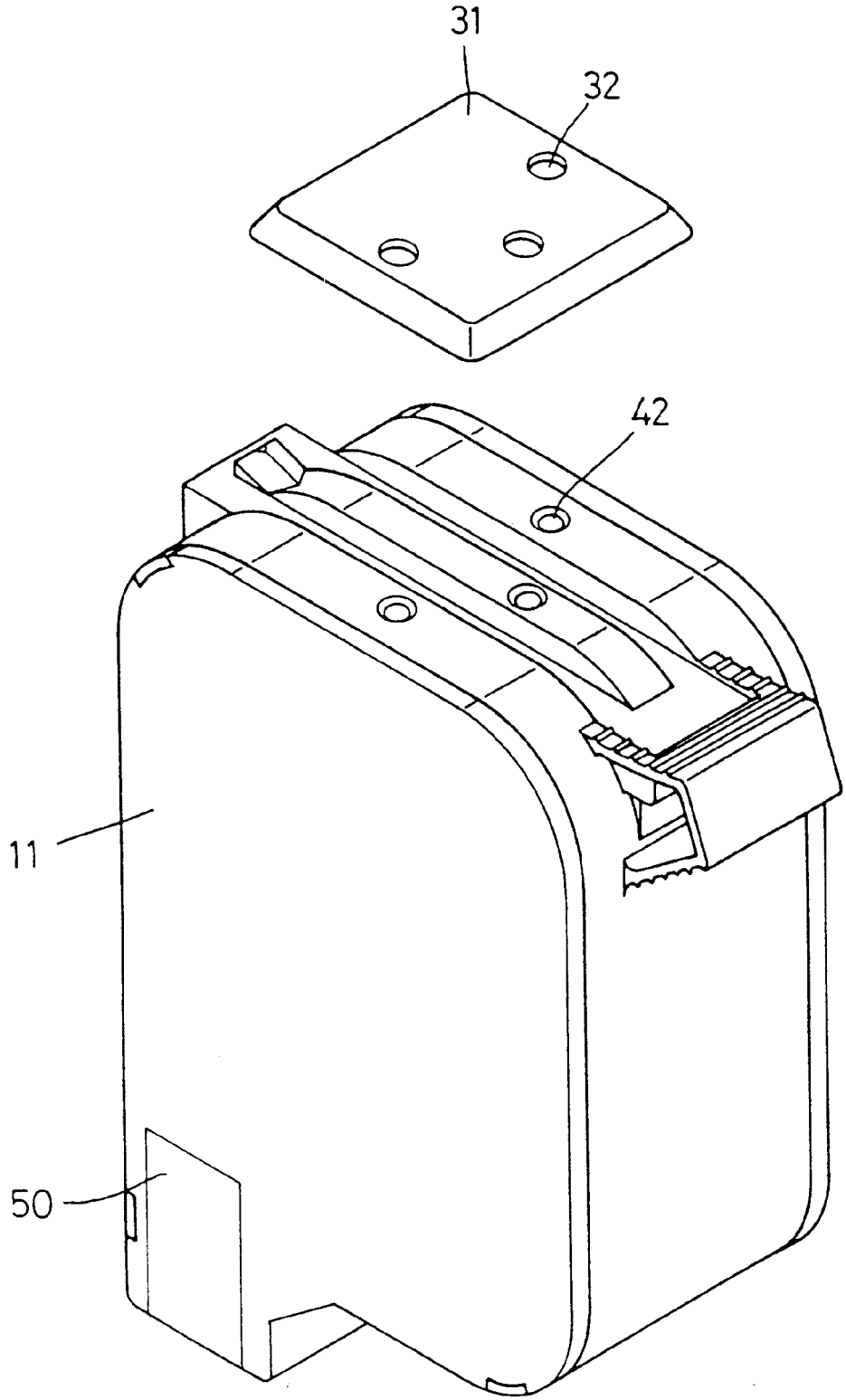
FIG. 12 is a disassembled view of the present invention, showing a rubber piece being separated from the ink cartridge.
Figure 13:
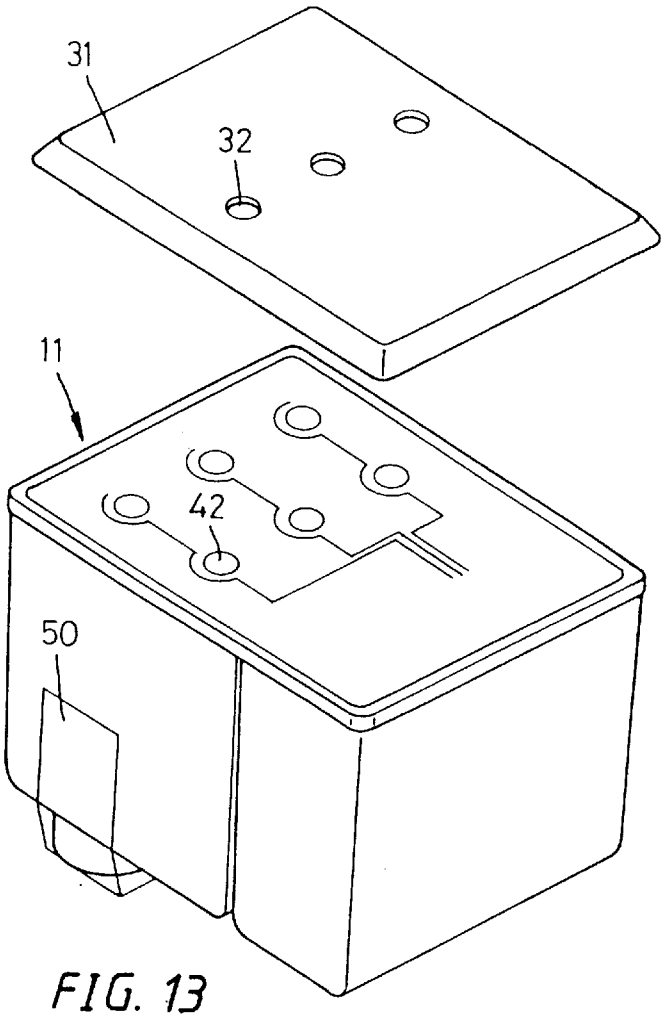
FIG. 13 is a disassembled view of the present invention, showing a rubber piece being separated from the ink cartridge.
Figure 14:
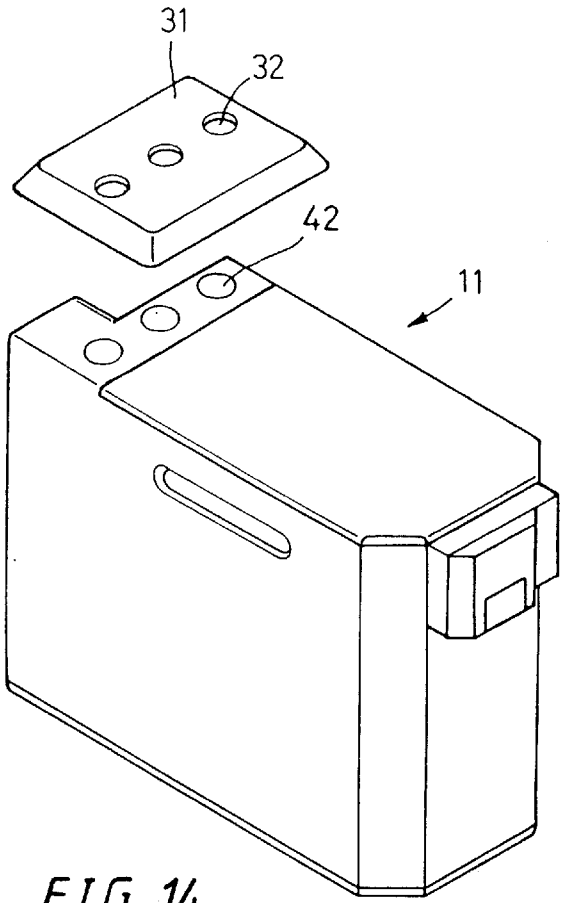
FIG. 14 is a disassembled view of the present invention, showing rubber piece being separated from the ink cartridge.
Figure 15:
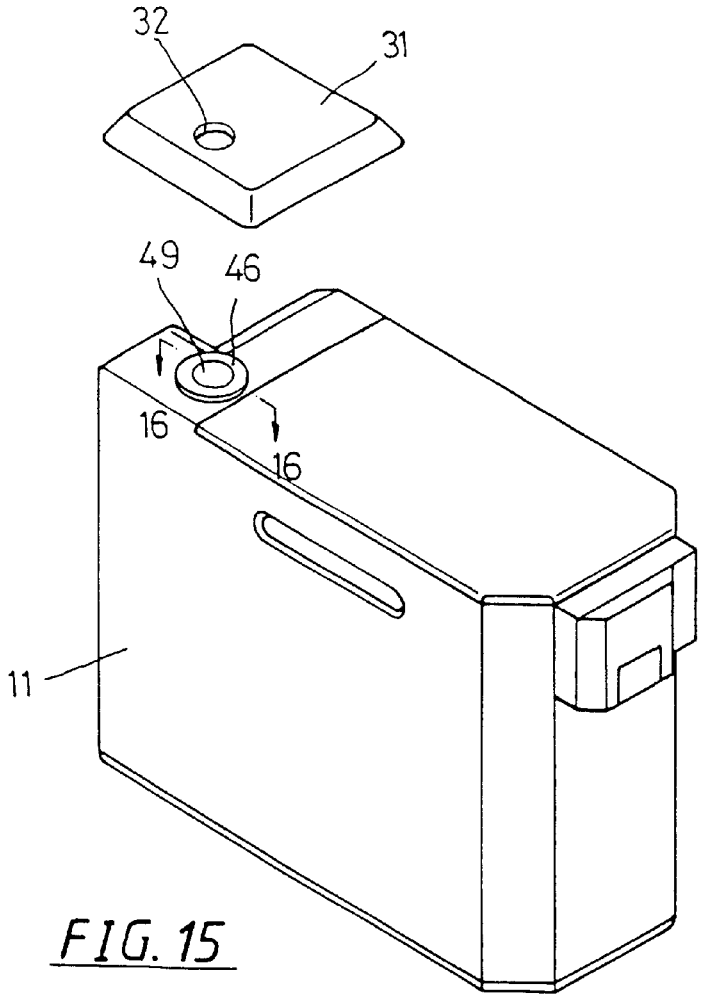
FIG. 15 is a disassembled view of the present invention, showing a rubber piece being separated from the ink cartridge.
Figure 16:
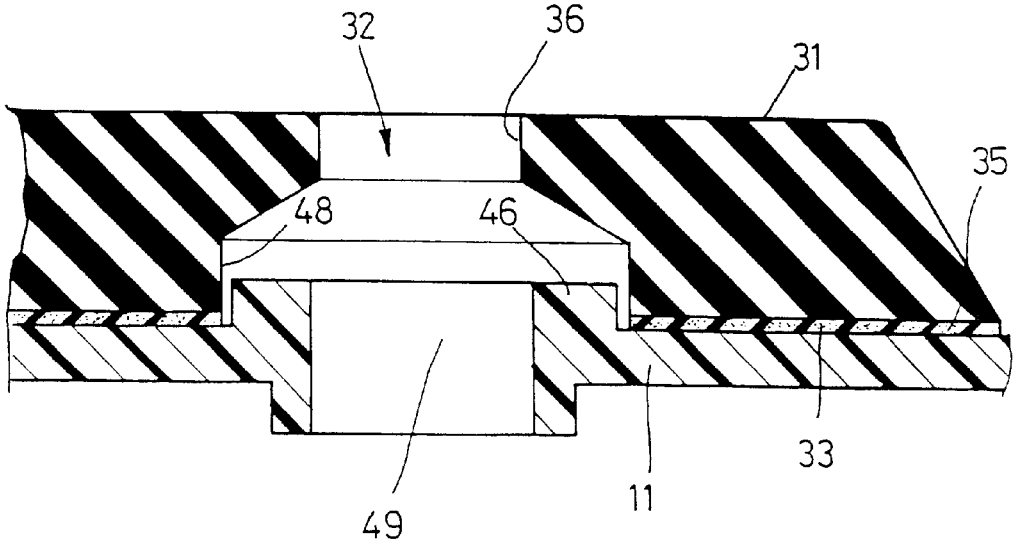
FIG. 16 is a fragmental section view of the present invention taken along line 16—16 as shown in FIG. 15.

The shape, size and position of the refilling hole 32 of the rubber piece 31 are designed in accordance with the shape of different ink cartridges. After the release paper on the inner side of the rubber piece 31 is removed, the rubber piece 31 can be glued to the outer flat surface of the refilling hole of the ink cartridge. The aforesaid rubber piece can be used for the ink cartridge CANON BC-5 as shown in FIG. 12, the ink cartridge EPSON S020049 as shown in FIG. 13, the ink cartridge HP 51641A as shown in FIG. 14, and the ink cartridge CANON BC-01 as shown in FIG. 15. Referring to FIGS. 15 and 16, the outer section of the refilling hole 32 of the rubber piece 31 may be furnished with a cylindrical hole 36 in the event of the refilling hole 49 having a flange ring 46; the inner section of the refilling hole 32 is furnished with a cylindrical hole 48, of which the size is slightly larger than that of the flange ring 46. The inner side 33 of the rubber piece 31 is glued to the flat side of the flange ring 46 by using the adhesive 35 so as to cover the outer side of the refilling hole 49. To refill, the refilling hole 32 must connect with the bottle mouth of the ink bottle so as to inject ink into the ink chamber 12 of the ink cartridge 11.

The rubber piece according to the present invention is furnished at least with one refilling hole; the inner side 33 of the rubber piece 31 is furnished with an adhesive 35 to be attached around the refilling hole of the ink cartridge 11 hermetically. The outer end of the refilling hole 32 of the rubber piece 31 is closely connected with the taper-shaped bottle mouth 39 of the ink bottle 38. In accordance with the aforesaid description, the ink injected into the ink chamber of the ink cartridge will not leak out.

What is claimed is:

1. A refilling device for an ink cartridge having at least one refilling opening in an upper portion and a lower portion having a cylindrical hole in which is located a regulating bead, an air vent opening and a maze passage in fluid connection with the air vent opening and the cylindrical hole, the refilling device comprising:

a) a rubber member having an outer surface and an inner surface;

b) at least one refilling hole extending through the rubber member between the inner and outer surfaces, the at least one refilling hole comprising a cylindrical portion extending inwardly from the outer surface and a frusto-conical portion extending from the cylindrical portion to the inner surface, a cross-sectional dimension of the frusto-conical portion increasing in a direction toward the inner surface, a largest diameter of the frusto-conical portion being greater than a diameter of one of the air vent opening and refilling opening; and, c) a layer of adhesive material on at least a portion of the inner surface adhesively bonding the rubber member to the ink cartridge such that the refilling hole is aligned with one of the air vent opening and the at least one refilling opening in the ink cartridge.

2. the refilling device of claim 1 wherein the adhesive layer extends around the refilling hole.

3. The refilling device of claim 1 wherein the rubber member is adhesively bonded to the lower portion of the ink cartridge such that the refilling hole is aligned with the air vent opening.

4. The refilling device of claim 1 wherein the rubber member is adhesively bonded to the upper portion of the ink cartridge such that the refilling hole in the rubber member is aligned with the at least one refilling opening in the ink cartridge.

5. The refilling device of claim 4 wherein the ink cartridge has a plurality of refilling openings and further comprising a plurality of refilling holes through the rubber member located such that each refilling hole is aligned with a refilling opening when the rubber member is adhesively bonded to the ink cartridge.

6. the refilling device of claim 4 wherein the ink cartridge has an upstanding flange extending around the refilling opening of the ink cartridge, and, wherein the refilling hole of the rubber member further comprises a second cylindrical portion extending inwardly from the inner surface in communication with the frusto-conical portion, a diameter of the second cylindrical portion being greater than a diameter of the upstanding flange, and a length of the second cylindrical portion being greater than a height of the upstanding flange.

* * * * *